United States Patent [19]

Roznieck

[11] Patent Number: 4,567,948

[45] Date of Patent: Feb. 4, 1986

[54] FIRE EXTINGUISHER VALVE

[76] Inventor: Edward J. Roznieck, 31041 Angeline, St. Clair Shores, Mich. 48082

[21] Appl. No.: 692,954

[22] Filed: Jan. 22, 1985

[51] Int. Cl.[4] ..... A62C 13/24; A62C 23/00

[52] U.S. Cl. ..... 169/76; 169/71; 169/89; 169/75; 222/402.1

[58] Field of Search ..... 169/30, 71, 74, 75, 169/76, 89; 239/337; 222/402.24, 402.1, 514

[56] References Cited

U.S. PATENT DOCUMENTS 3,713,493 1/1973 Hansen ..... 169/75

*Primary Examiner*—Jeffrey V. Nase

*Attorney, Agent, or Firm*—Peter A. Taucher; Gail S. Soderling; Robert P. Gibson

[57] ABSTRACT

A portable fire extinguisher designed to increase the discharge velocity and maximum throw distance of the extinguishant. A poppet type valve manually operable to open and close the extinguisher. Tappets placed outside the path of the discharging extinguishant and a smoothly finished discharge passage to provide an obstruction free discharge path. The obstruction free discharge path reduces turbulence and the resultant pressure drop in the extinguishant and increases both the discharge rate and throw distance.

10 Claims, 3 Drawing Figures

FIRE EXTINGUISHER VALVE

GOVERNMENT INTEREST

The invention described herein may be manufactured, used, and licensed by or for the Government for governmental purposes without payment to me of any royalty.

BACKGROUND

This invention relates to a novel valve for pressurized liquid fire extinguishers. More specifically, my invention improves the distance pressurized extinguishant may be thrown from a portable fire extinguisher.

Some forms of fire, such as chemical fires, burn at very high temperatures. Approaching these fires is very difficult due to the extreme heat or dangerous fumes. Conventional portable Halon 1301 type extinguishers are only capable of throwing extinguishant about four to eight feet. My invention doubles this throw distance by using a nonobstructing manual extinguisher valve and smooth discharge conduit.

Many manually operable extinguisher valves exist. One example of this type of valve is shown in U.S. Pat. No. 3,009,681, issued to P. M. Carter, et.al., Dec. 30, 1955. It discloses a pair of frustoconical valve heads seated in a tapered discharge passage. A rod attached to the heads opens and closes the extinguisher. When the extinguisher is open, the rod remains in the discharge passage inducing turbulence in the discharging extinguishant and partially blocking its flow. The turbulence created by the rod reduces the pressure at the exit nozzle. The reduced pressure at the exit nozzle reduces the exit velocity and maximum distance the extinguishant can travel.

Another type of common extinguisher valve uses a foil diaphram to seal the extinguishant in the bottle until needed. To discharge the extinguisher, the operator causes a knife to tear the diaphram and release the pressurized extinguishant. An example of this type of extinguisher valve is shown in my U.S. Pat. No. 4,476,937. The ruptured diaphram does not significantly block the flow of extinguishant, however, the extinguisher cannot be partially discharged. Once the diaphram is shorn, the entire charge of extinguishant is released. Also, such a valve requires rebuilding before it can be reused.

The principle aim of my invention is to reduce the turbulence induced pressure drop in the discharging extinguishant by keeping the discharge path as obstruction free as possible. The increased throw distance of my invention makes the extinguisher more effective at putting out fires and safer for operators because they need not approach the fire as closely.

Turbulence in the extinguisher is caused or enhanced by obstructions, sharp angles or rough surfaces in the discharge passage. By making the discharge passage as obstruction free as possible, the amount of turbulence in the extinguishant and the resultant pressure drop at the exit nozzle is kept to a minimum. This increases both the exit velocity and the maximum throw distance of the extinguishant. Increasing the exit velocity allows more extinguishant to be directed to the fire in a shorter period of time.

Objects of the invention are to provide a fire extinguisher valve wherein:

1. The valve has no blockage of the extinguisher discharge path to reduce turbulence and pressure drops in the extinguishant, whereby the extinguishant has a fast exit velocity and longer throw distance.

2. The valve provides a leak-proof seal for long time non-use storage.

3. The valve is fast opening.

4. The valve may be reused without any rebuilding.

5. The valve has smooth interior surfaces to further reduce turbulence and increase the extinguishant throw.

The extinguisher uses a poppet type valve to release extinguishant. Two tappet rods recessed within the valve housing on either side of the discharge passage open and closed the poppet valve. The tappets are placed outside of the discharge path and do not interfere with the extinguishant flow or create turbulence when the extinguisher is used. The discharge passage has smooth interior surfaces and a smoothly curved path from the bottle to the nozzle. The shape and finish of the unobstructed discharge path reduce the turbulence of the discharging extinguishant which increases both the maximum throw distance and exit velocity.

My invention may be used with any type of pressurized fire extinguishant but is particularly well suited for portable pressurized Halon type extinguishers.

DETAILED DESCRIPTION OF THE DRAWINGS

Figure 1:
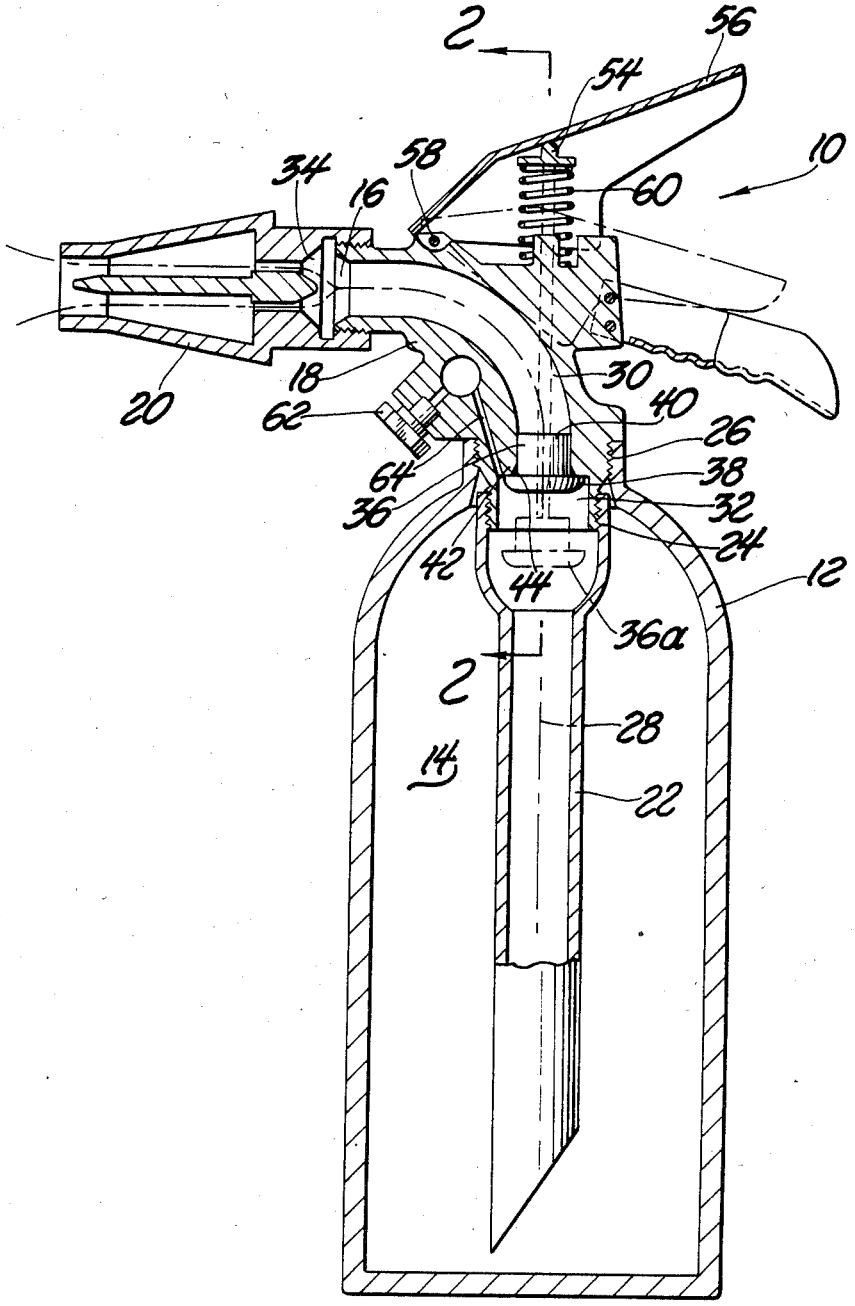
FIG. 1 is a side sectional view of my invention attached to a thick walled bottle.
Figure 2:
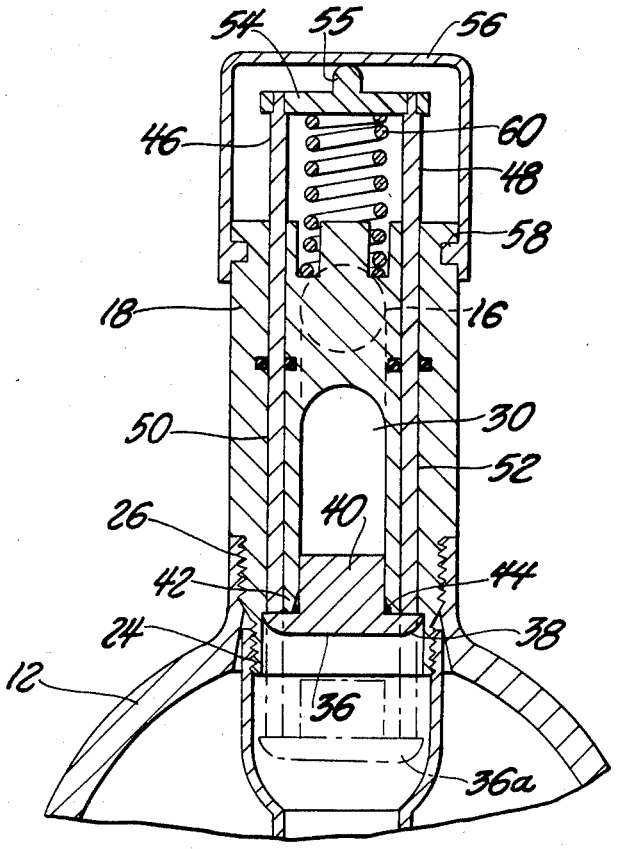
FIG. 2 is a detailed sectional view taken along the line 2—2 in FIG. 1.

In FIG. 1 and FIG. 2 there is shown my fire extinguisher valve 10 attached to a bottle 12 capable of containing approximately 600 p.s.i. of pressurized liquid fire extinguishant 14, such as Halon 1301 and propellant, such as nitrogen. An opening 16 in housing 18 accepts a nozzle 20. Shown is a nozzle 20 similar to the type disclosed in my in my copending application, Ser. No. 474,398, now U.S. Pat. No. 4,484,710. However, extinguisher valve 10 may be used with any type of nozzle or no nozzle at all.

Before housing 18 is attached to bottle 12, a syphon or dip tube 22 is attached to narrow threads 24. When the extinguisher is to be used in an upright position, narrow threads 24 are located approximately perpendicular to opening 16. Wide threads 26 are located inward from narrow threads 24. Wide threads 26 attach housing 18 to bottle 12. Wide threads 26 have a diameter greater than dip tube 22 and allow dip tube 22 to be inserted in the bottle along the central bottle axis 28.

Communicating opening 16 with the interior of bottle 12 is a radially curved cylindrical conduit 30. Conduit 30 has an inlet end 32 and an exit end 34. Inlet end 32 fluidly communicates with dip tube 22 and exit end 34 fluidly communicates with opening 16. Conduit 30 has smooth interior faces to minimize turbulence in the discharging extinguishant. The curvature of conduit 30 is smoothly curved to provide minimum hindrence to extinguishant discharge.

The pressurized extinguishant 14 is sealed within bottle 12 by a poppet valve 36. Poppet valve 36 comprises a disk shaped head 38 and a rod like projection 40. Projection 40 is attached to the upper side of head 38. Projection 40 extends within inlet end 32 when poppet valve 36 is in its illustrated closed position and aligns poppet valve 36 centrally along the central bottle axis 28. Head 38 registers with corresponding seating area 42 surrounding inlet end 32 of the housing. A non-metallic O-ring seal 44 lies between seating area 42 and head 38. When poppet valve 36 is in its illustrated closed position, head 38 compresses seal 44 against seating area 42 to form a long time leak-proof seal.

Attached near the periphery of head 38 are two tappet rods 46, 48. They are located radially beyond the area of the head that registers with seating area 42. Tappets 46, 48 slide linearly through two parallel tappet guide passages 50, 52, respectively, bored through housing 18. Guide passages 50, 52 are on either side of conduit 30. The tappets 46, 48 extend slightly beyond housing 18 and are connected by a bar 54. A handle 56 is attached to housing 18 and engages knob 55 on bar 54 when depressed. Handle 56 is attached to housing 18 by a pivotal connection 58. When the operator manually squeezes handle 56, bar 54 depresses tappets 46, 48 which cause the extinguisher valve 10 to release the pressurized extinguishant. Tappets 46, 48 unseat poppet valve 36 and force it to its open position (shown in outline position 36*a*). Poppet valve 36 is pushed sufficiently far from inlet end 32 to allow the unobstructed discharge of extinguishant through conduit 30.

When handle 56 is released, the force of the pressurized extinguishant 14 on the lower face of head 38 pushes poppet valve 36 to its closed position sealing the extinguisher for further use. The extinguisher may be partially discharged and seal 44 will prevent leakage of the pressurized extinguishant 14.

To aid in sealing the extinguisher, a compression spring 60, placed between housing 18 and bar 54, urges poppet valve 36 to its closed position. The tension in spring 60 combines with the force on head 48 from the pressurized extinguishant to urge poppet valve 36 firmly against seating area 42. Squeezing handle 56 compresses spring 60 and releases the extinguishant. Spring 60 is especially useful in sealing bottle 12 when the extinguishant pressure is not great enough to independently urge poppet valve 36 closed.

Figure 3:
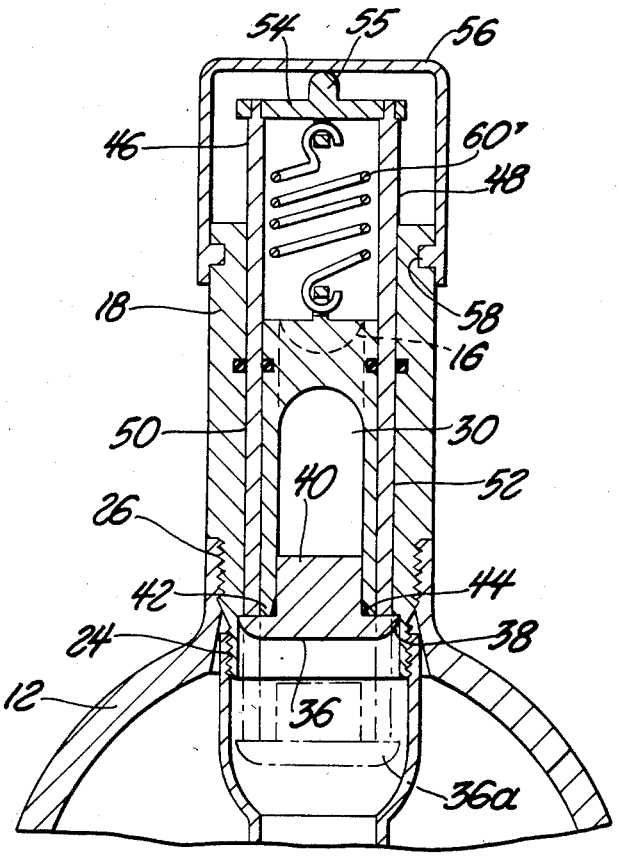
FIG. 3 is a detailed sectional view of an alternative embodiment of my invention taken similar to the view of FIG. 2.

When very high extinguishant pressures are used, the force required to squeeze handle 56 may be too great for fast and easy operations of the extinguisher. To make operation of the extinguisher easier with the high extinguishant pressure, compression spring 60 may be replaced with a tension spring 60' (FIG. 3). The tension spring 60' would be attached to bar 54 and housing 18 and normally urge poppet valve 36 to its open position 36*a*. The force of pressurized extinguishant 14 on head 38 must be great enough to tense the spring and seal bottle 12.

A relief valve 62 is provided in housing 18 to vent the extinguishant if the pressure within the bottle exceeds a predetermined value. Relief valve 62 communicates with the pressure in inlet end 32 through passage 64.

OPERATION

To charge the extinguisher, the nozzle 20 is removed from opening 16. A source of pressurized extinguishant (not shown), such as Halon 1301, is attached to opening 16. Handle 56 is depressed to open poppet valve 36 and fill bottle 12 to the desired pressure or weight of pressurized extinguishant 14. The source of pressurized extinguishant is replaced with a source of pressurized propellant (not shown), such as nitrogent, and the extinguisher charged to its operating pressure (e.g., 600 p.s.i.). Handle 56 is released and poppet valve 36 closes. The pressurized propellant source is removed and nozzle 20 replaced. If spring 60' is a tension type spring, bar 54 must be manually pushed upward before the pressurized extinguishant or propellant source is removed.

When the extinguisher is needed, the operator holds it in a generally upright manner and aims the nozzle toward the bottom of the fire while squeezing handle 56. Poppet valve 36 opens to outline position 36*a* and pressurized extinguishant flows up dip tube 22. The extinguishant 14 continues through conduit 30 in liquid form and is then directed by nozzle 20 to the fire. When the extinguisher is not needed further, the operator releases handle 56. Poppet valve 36 is urged to its closed position by spring 60 and the remaining extinguishant pressure and seals the extinguisher for future use. If spring 60' is a tension spring, the remaining extinguishant pressure on the lower face of head 38 pushes poppet valve 36 to its closed position, tensing spring 60'. The area of head 38 and the force of spring 60' are calibrated so that the extinguisher is sealed if the extinguisher pressure is 200 p.s.i. or greater.

The valve structure disclosed doubles the maximum throw distance of a pressurized extinguisher over prior extinguisher designs. The principle advance was the reduction of blockage in the discharge path. The extinguisher uses a fast opening reusable poppet valve to seal the pressurized extinguishant. The valve is opened and closed by two tappet rods placed outside the discharge path and attached near the periphery of the poppet valve and push it sufficiently away from the inlet to allow the unobstructured discharge of extinguishant.

The arrangement of the tappet rods and the finish and curvature of the discharge conduit were only possible after the realization of their effect on the discharging stream's turbulence and pressure drop. Turbulence and the resulting pressure drop have long been recognized as a limiting factor on the extinguishant's maximum velocity. Some large extinguishers have reduced turbulence to reduce the time necessary to discharge a quantity of extinguishant. These designs generally have reduced turbulence by using thin diaphrams that are shorn away when the extinguisher is discharged. These designs were primarily concerned with discharge time rather than throw distance and do not allow for partial discharge of the bottle.

My invention reduces turbulence and resultant pressure drop primarily to increase the maximum throw distance and allow the extinguisher to function at longer distances, protecting the operator from the heat and vapors of modern fires. It provides for a low cost resealable extinguisher valve capable of throwing extinguishant almost twice as far as current portable extinguisher designs, while simultaneously meeting the long term sealing requirements demanded of pressurized fire extinguishers.

I wish it to be understood that I do not desire to be limited to the exact details of construction shown and described for obvious modifications will occur to a person skilled in the art, without departing from the spirit and scope of the appended claims.

What is claimed is:

1. In a fire extinguisher comprising: a bottle; a pressurized extinguishant in said bottle; a housing attached to said bottle; an opening in said housing; a conduit in said housing, said conduit having an inlet and an exit end, said inlet end communicating with said bottle, said exit end communicating with said opening, said conduit having smooth interior faces; a poppet valve in said conduit, said poppet valve sealing said bottle; at least one tappet rod having a first and second end said tappet rod attached at said first end to said poppet valve, at least one tappet guide passage through said housing not intersecting said conduit; said tappet rod slidably engaged within said tappet guide passage, whereby said tappet rod causes said poppet valve to move to an open position and releasing said extinguishant when depressed.

2. The fire extinguisher of claim 1 wherein said opening is perpendicular to said bottle, and said conduit is radially curved between said inlet end and said exit end, whereby said extinguisher is operated in a generally upright manner.

3. The fire extinguisher of claim 2 wherein said poppet valve comprises a generally cylindrical head, said head having a first side and a second side; a projection attached to said first side, a seating surrounding said inlet end, said first side registers with said seating when said poppet valve is in a closed position; said projection centrally aligns said first side with said seating when said poppet valve is in said closed position, said pressurized extinguishant acts on said second side to urge said poppet valve to said closed position.

4. The fire extinguisher of claim 3 and further comprising a non-metallic O-ring seal between said first side and said seating to retain said extinguishant in said bottle when said poppet valve is in said closed position.

5. The fire extinguisher of claim 4 and further comprising a handle pivotably attached to said housing, said handle depresses said tappet rod to cause said poppet valve to travel to an open position, said open position allowing an unobstructed flow of pressurized extinguishant between said bottle and said exit end.

6. The fire extinguisher of claim 5 and further comprising a spring attached to said second end, between said second end and housing normally urging said poppet valve to said closed position and sealing said pressurized extinguishant in said bottle.

7. The fire extinguisher of claim 6 and further comprising a nozzle means attached to said opening.

8. The fire extinguisher of claim 5 and further comprising a spring attached to said second end and said housing, normally urging said poppet valve to said open position.

9. In a fire extinguisher comprising: a bottle; a pressurized extinguishant in said bottle; a housing threadably attached at one end to said bottle; an opening in said housing perpendicular to said bottle; a conduit in said housing communicating said pressurized extinguishant with said opening, said conduit having an inlet end and an exit end, said inlet end communicating with said bottle and said exit end communicating with said opening, said conduit being radially curved between said inlet and said exit ends and having smooth interior faces; a poppet valve having a generally cylindrical head, said head having a first side and a second side, a projection attached to said first side, a seating surrounding said inlet end, said first side registers with said seating when said poppet valve is in a closed position; said projection centrally aligns said first side with said seating when said poppet valve is in said closed position; said pressurized extinguishant acts on said second side to urge said poppet valve to said closed position; a non-metallic O-ring seal between said first side and said seating to retain said extinguishant in said bottle when said poppet valve is in said closed position; two tappet rods having a first and second end attached at said first end near the periphery of said first side, two parallel tappet guide passages through said housing, said inlet end and said conduit being located centrally between said tappet guide passages, said tappet rods slidably engaged within said guide passages, said second end of said tappet rods extending beyond said housing; a bar attached between said second ends; a handle pivotably attached to said housing, said handle depresses said tappet rods to cause said poppet valve to travel to an open position, said open position allowing an unobstructed flow of pressurized extinguishant between said bottle and said exit end; a spring means between said bar and said housing normally urging said poppet valve to said closed position.

10. In a fire extinguisher comprising: a bottle; a pressurized extinguishant in said bottle; a housing threadably attached at one end to said bottle; an opening in said housing perpendicular to said bottle; a conduit in said housing communicating said pressurized extinguishant with said opening, said conduit having an inlet end and an exit end, said inlet end communicating with said bottle and said exit end communicating with said opening, said conduit being radially curved between said inlet and said exit ends and having smooth interior faces; a poppet valve having a generally cylindrical head, said head having a first side and a second side, a projection attached to said first side, a seating surrounding said inlet end, said first side registers with said seating when said poppet valve is in a closed position; said projection centrally aligns said first side with said seating when said poppet valve is in said closed position; said pressurized extinguishant acts on said second side to urge said poppet valve to said closed position; a non-metallic O-ring seal between said first side and said seating to retain said extinguishant in said bottle when said poppet valve is in said closed position; two tappet rods having a first and second end attached at said first end near the periphery of said first side, two parallel tappet guide passages through said housing, said inlet end and said conduit being located centrally between said tappet guide passages, said tappet rods slidably engaged within said guide passages, said second end of said tappet rods extending beyond said housing; a bar attached between said second ends; a handle pivotably attached to said housing, said handle depresses said tappet rods to cause said poppet valve to travel to an open position, said open position allowing an unobstructed flow of pressurized extinguishant between said bottle and said exit end; a spring attached to said bar and to said housing between said tappet rods normally urging said poppet valve to said open position.

* * * * *